US005328739A

United States Patent [19]

Heselius et al.

[11] Patent Number: 5,328,739

[45] Date of Patent: Jul. 12, 1994

[54] CONSTRUCTION BOARD

[75] Inventors: Lars Heselius; Esko Brunila, both of Pargas, Finland

[73] Assignee: Oy Partek AB, Pargas, Finland

[21] Appl. No.: 690,907

[22] PCT Filed: Dec. 15, 1989

[86] PCT No.: PCT/FI89/00233

§ 371 Date: Aug. 16, 1991

§ 102(e) Date: Aug. 16, 1991

[87] PCT Pub. No.: WO90/07038

PCT Pub. Date: Jun. 28, 1990

[30] Foreign Application Priority Data

Dec. 16, 1988 [FI] Finland ..... 885849

[51] Int. Cl.[5] ..... B32B 3/00; B32B 3/10; B32B 3/14; B32B 3/16

[52] U.S. Cl. ..... 428/53; 428/54; 428/55; 428/56; 428/74; 428/76; 428/290

[58] Field of Search ..... 428/53, 54, 111, 290, 428/55, 56, 74, 76

[56] References Cited

U.S. PATENT DOCUMENTS

| | | | |
|---|---|---|---|
| 2,869,598 | 1/1959 | Loetscher | 144/309 |
| 3,046,181 | 7/1962 | Mann et al. | 156/274 |
| 3,168,763 | 2/1965 | Gilbert | 20/35 |
| 3,230,995 | 1/1966 | Shannon | 156/166 |
| 3,686,061 | 8/1972 | Brown et al. | 161/56 |
| 4,093,762 | 6/1978 | Kiefer | 428/55 |
| 4,238,257 | 12/1980 | Remi et al. | 156/71 |
| 4,402,781 | 9/1983 | Couture et al. | 156/274.6 |
| 4,429,503 | 2/1984 | Holliday | 52/410 |
| 4,512,840 | 4/1985 | Marino | 156/304 |
| 4,618,387 | 10/1986 | Fisher et al. | 156/244.11 |
| 5,073,426 | 12/1991 | Blaaw | 428/56 |

FOREIGN PATENT DOCUMENTS

| | | | |
|---|---|---|---|
| 0128230 | 5/1991 | Japan | 428/55 |
| 368949 | 7/1974 | Sweden . | |
| 8205778 | 11/1985 | Sweden | E04B 1/78 |
| 1400692 | 7/1975 | United Kingdom . | |

*Primary Examiner*—George F. Lesmes
*Assistant Examiner*—Terrel Morris
*Attorney, Agent, or Firm*—Pennie & Edmonds

[57] ABSTRACT

A longitudinal laminate board of binder fixed mineral wool. The laminate board consists of adjacently disposed longitudinally directed pieces, whose fibre planes form a right angle to the plane of the laminate board. The length of the pieces is less than half of that of the laminate board and they are jointed to each other. None of the joints is immediately next to any of the ends of the laminate board or to any of the supports for the board.

5 Claims, 1 Drawing Sheet

CONSTRUCTION BOARD

FIELD OF THE INVENTION

The invention relates to a longitudinal laminate board of binder fixed mineral wool, which is suitable as a core of a sandwich element, having surface layers, e.g. of sheet metal, on each side, consisting of adjacently disposed rods whose longitudinal direction forms a right angle to the plane of the laminate board.

BACKGROUND OF THE INVENTION

Laminate boards of this type are prior known, having been used for instance in shipbuilding industry as insulating walls of various spaces.

Sandwich elements of mineral wool have been utilized to some extent in building industry. However, so far long elements have not been available, neither as roof or floor elements, nor as wall elements.

The idea of rotating cut laminates 90° and of reassembling them in the turned position, thus providing a laminate board having fibres orientated perpendicularly to the plane of the board, is prior known. Such a laminate board has excellent resistance properties and is able to transmit shearing forces between its surface planes.

Finished sandwich elements of mineral wool with the fibres orientated perpendicularly to the surface plane of the element would be usable as roof, floor and wall elements, thus simplifying construction operations noticeably.

SUMMARY OF THE INVENTION

The object of the present invention is to provide long laminate boards which are usable as a core of supporting sandwich elements for roof, floor and wall constructions.

According to the invention, this object has been achieved by composing the laminate board of rods, the length of which is less than half of the length of the laminate board and by bringing these aligned rods into contact without intervals, thus forming joints, and none of the joints is in the immediate vicinity of any of the ends of the laminate board, when the board is being used as a one-field board having supports at the ends, or immediately next to a support line, when the board is being used as a multi-field board.

According to the invention, a long construction board, of up to 9–10 m, can be provided by means of laminates rotated and assembled in the same manner, without handling mineral wool mats and cut laminates of a corresponding length that is, a length of 9–10 m. By composing the laminate board of aligned rods of a length that is less than half of the length of the laminate board so that aligned rods are in contact without intervals, forming joints between each other, and by appropriately distributing the joints over the surface of the laminate board, a board is achieved which, when used as a core of a sandwich element, has resistance properties corresponding to a board without joints, i.e. in which the weakening effect of the joints has been eliminated.

According to a preferred embodiment of the laminate board, none of the joints is disposed closer to a support of the laminate board than when a = L divided by 1.9 n where L equals the length of the laminate board, when the board is being used as a one-field board supported at its ends, and L equals the span, when the board is being used as a multi-field-board and also supported intermediated its ends, and n equals the number of laminates laterally in the laminate board.

The parametre a indicates the length of the critical area within which the existence of joints has to be limited in order to prevent the joints from weakening the resistance of the board when used in building constructions. Critical areas exist next to the ends of the board, where the boards are supported, and next to the support lines between the ends. A force concentration namely arises at intermediate supports like at the ends, when the support points are provided there. The conclusion concerns elements in a horizontal position as well as elements in a vertical position.

As a general rule the distance a, indicating the length of the critical area, equals L divided by 2 n since the support lines, among others, have a certain extension or width, the length a should be somewhat longer, and thus the length L is appropriately divided by 1.90 n.

According to another preferred embodiment, maximally one joint is disposed within the distance *2a* from any of the ends or support lines of the laminate board. According to a further development of the invention, maximally two joints are within the distance *3a* from any of the ends or support lines of the laminate board.

Further, maximally three joints should preferably be included within any interval a along the length of the laminate board.

Further, the distance between the joints of two adjacent rows of joints should preferably equal at least the thickness of the rods.

These parametres a, L and n are significant when producing the laminate boards according to the invention. As described more in detail in our copending application Ser. No. 07/690,906 filed on the same date, the laminate boards are manufactured by cutting rods or lamella pieces from mineral wool mats that are shorter than the laminate board rods. These are cut in the longitudinal direction of the wool mat. The rods are then turned 90° and assembled with end faces against each other into long rods, which consequently will comprise equally spaced joints. From these long rods, lamella pieces of the desired length are cut and assembled into a laminate board. The position of the joints in the laminate board is determined by the length of the rods having been cut and assembled into a long rod with regard to the length of the laminate board and by the manner in which the long rods are assembled into a laminate board.

According to the present invention, it is essential that the joints be distributed over the laminate board and especially with regard to the zone next to the ends and the support points so as to eliminate the weakening influence of the joints. This relation is obtained by fulfilling the conditions herein for the parametres a, L and n.

The parametres a, L and n are used for determining the exact position for cutting off a long rod into a laminate of the laminate board and for phase displacing the long rod with regard to the preceding long rod in the board. The parametres are used for programing a computer for automatic control of the cutting of the long rods.

BRIEF DESCRIPTION OF THE DRAWINGS

A preferred embodiment of the laminate board according to the invention is described below with reference to the drawings of which

DETAILED DESCRIPTION OF THE INVENTION

Figure 1:
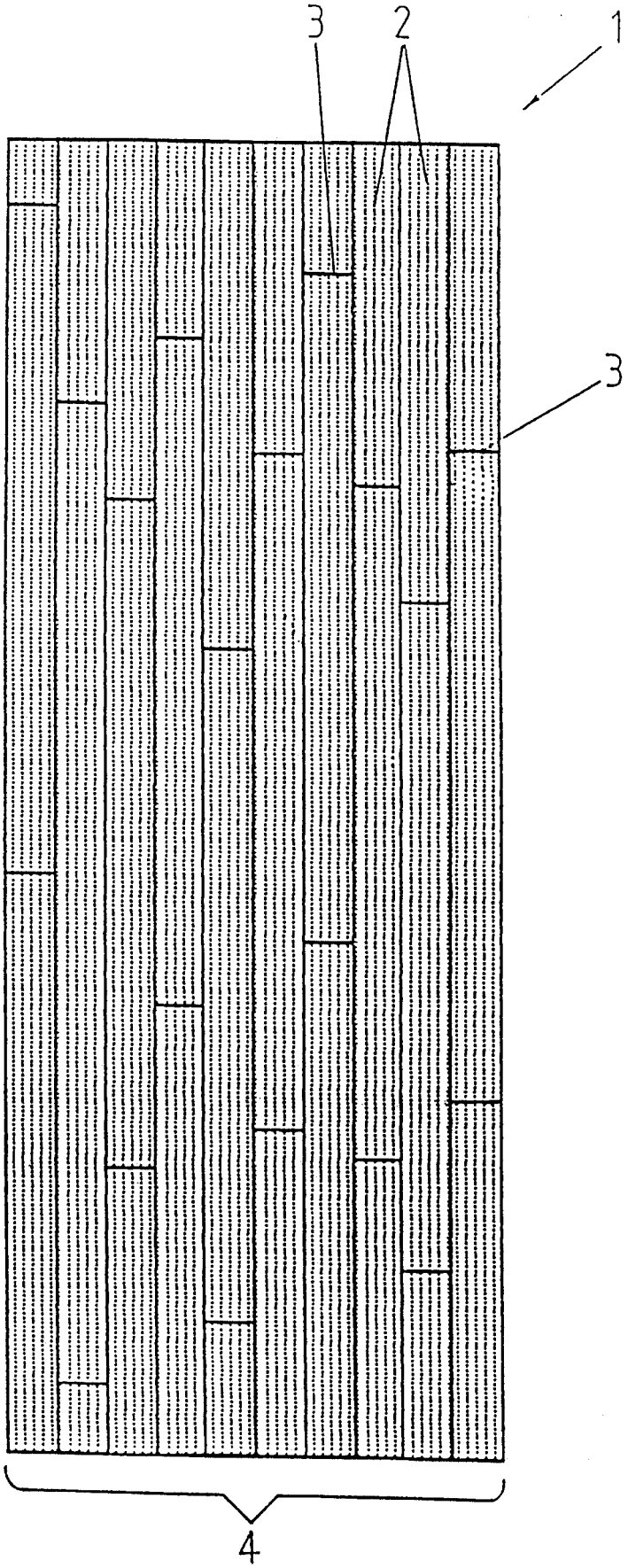
FIG. 1 is a plan view of the lamella board of the present invention.

FIG. 1 shows a preferred embodiment of the laminate board according to the invention. The laminate board is indicated by 1, the rods or lamella pieces by 2, the joint between the rods forming laminates or lamellas (4) of the laminate board by 3. A lamella (4) is defined by each row of end to end rods (2). There are 10 lamella (4) in the board shown in FIG. 1. In the rods 2 forming each laminate or lamella (4), the vertical orientation of the fibre plane has been indicated.

It can be noted that the joints 3 are relatively equally distributed over the laminate board and a comparison with the parametres a, L and n, mentioned above, shows that all the criteria are being fulfilled.

As described in our copending application mentioned above, the manufacture of the laminate board is carried out by assembling laterally rods that have been cut from a mineral wool and rotated in order to form the laminate board. The assembling of the rods that have been cut and rotated can be accomplished in various manners.

In a preferred manner, the rods are assembled consecutively into a long rod, from which rods having the desired length equal to the length of the laminate board are cut and assembled into a laminate board.

In another preferred manner, several rods are cut from the mineral wool sheet and rotated and subsequently phase displaced axially. The phase displaced rods are subsequently assembled, with end faces against each other, with the preceding flow of correspondingly cut and phase displaced rods to form a flow of long rods. From this flow a lamella of a length equalling that of the laminate board is cut off. After that, two surface layers are applied onto the laminate board.

Provided with surface layers, which may be of thin sheet metal, a concrete layer, minerite or similar, the construction board according to the invention is usable as a supporting wall or roof element. Owing to its construction, the board has good fire and heat insulating properties and is simple.

We claim:

1. In a longitudinally extending lamella board (1) having opposed maim surfaces and constructed of a plurality of side by side lamellas (4) of binder fixed mineral wool fibres having a first fibre orientation and defining a core for a sandwich element having a surface layer of sheet material on both main surfaces, the lamellas (4) extending in the longitudinal direction of the board and the first fibre orientation of the lamellas forming essentially a right angle to the main surfaces of the board, the improvement wherein the lamellas (4) consist of longitudinally aligned lamella pieces (2) having opposing end surfaces and being shorter than half of the length of the lamella board (1), the opposing end surfaces of aligned lamella pieces (2) forming a joint (3); and none of the joints being disposed immediately next to one end of the lamella board when the board is used as a one-field board with supports at the ends, or immediately next to a support when the board is used as a multi-field board with intermediate supports; and wherein none of the joints (3) is disposed closer to a support of the lamella board (1) than a length a, when a $=L/1.9\ n$, wherein L equals the length of the lamella board when the board is used as a one-field board, and L equals the distance between intermediate supports when the board is used as a multi-field board, and n equals the number of laterally adjacent lamellas (4) in the lamella board.

2. A lamella board according to claim 1 wherein maximally one joint (3) is disposed within the distance 2*a* from a support of the lamella board (1).

3. A lamella board according to claim 1, wherein maximally two joints (3) are within the distance 3*a* from a support of the lamella board (1).

4. A lamella board according to claim 1, wherein that maximally three joints (3) are within a certain interval of the lamella board, said interval having the longitudinal length a.

5. In a longitudinally extending lamella board (1) having opposed side surfaces and defining a core for a sandwich element having a surface layer of sheet material on both main surfaces, and wherein said lamella board (1) is constructed of a plurality of side by side lamellas (4) of binder fixed mineral wool fibres having a first fibre orientation, said lamellas (4) extending in the longitudinal direction of the board and the first fibre orientation of the lamellas forming essentially a right angle to the main surfaces of the board, and said surface layers being defined by a surface layer of sheet material on both main surfaces of said board, the improvement wherein the lamellas (4) consist of longitudinally aligned lamella pieces (2) having opposing end surfaces and being shorter than half of the length of the lamella board (1), the opposing end surfaces of aligned lamella pieces (2) forming a joint (3) having a weakening effect on the resistance of the board to force concentrations applied to the board; and none of the joints being disposed immediately next to one end of the lamella board when the board is used as a one-field board with supports at the ends, or immediately next to a support when the board is used as a multi-field board with intermediate supports; and wherein none of the joints (3) is disposed closer to a support of the lamella board (1) than a length a, when a $=L/1.9\ n$, wherein L equals the length of the lamella board when the board is used as a one-field board, and L equals the distance between intermediate supports when the board is used as a multi-field board, and n equals the number of laterally adjacent lamellas (4) in the lamella board.

* * * * *